US007265310B1

(12) United States Patent
Wang

(10) Patent No.: US 7,265,310 B1
(45) Date of Patent: Sep. 4, 2007

(54) KEY MECHANISM

(75) Inventor: Yi-Chen Wang, Tainan County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 11/566,660

(22) Filed: Dec. 4, 2006

(30) Foreign Application Priority Data

Dec. 30, 2005 (TW) ..... 94147640 A

(51) Int. Cl.
*H01H 13/70* (2006.01)

(52) U.S. Cl. ..... 200/344

(58) Field of Classification Search ..... 200/5 A, 200/517, 344, 345; 400/490, 491, 491.2, 400/495, 495.1, 496
See application file for complete search history.

(56) References Cited

U.S. PATENT DOCUMENTS 5,941,373 A * 8/1999 Cheng ..... 200/344
6,100,482 A * 8/2000 Koma et al. ..... 200/344
6,239,391 B1 * 5/2001 Nishijima et al. ..... 200/5 A
6,399,909 B1 * 6/2002 Okada ..... 200/344
6,495,782 B1 * 12/2002 Huang ..... 200/341
6,618,239 B2 * 9/2003 Takahashi et al. ..... 361/679
6,713,699 B2 * 3/2004 Yoneyama ..... 200/344
6,730,868 B1 * 5/2004 Watanabe ..... 200/344
6,815,627 B2 * 11/2004 Chen ..... 200/344
7,094,984 B2 * 8/2006 Yokoyama ..... 200/344
7,199,320 B2 * 4/2007 Sato ..... 200/341

* cited by examiner

*Primary Examiner*—Michael Friedhofer
(74) *Attorney, Agent, or Firm*—Quintero Law Office

(57) ABSTRACT

A key mechanism is disclosed. A base plate includes a first pivoting portion and a second pivoting portion opposing the first pivoting portion. A keycap is disposed on the base plate and includes at least one engaging portion. A linking bar is connected between the base plate and the keycap and includes a first body portion, two second body portions, and two curved portions. The first body portion is rotatably engaged in the engaging portion of the keycap. The second body portions are connected to the first body portion and oppose each other. The curved portions are connected to the second body portions and pivot to the first and second pivoting portions of the base plate, respectively.

4 Claims, 3 Drawing Sheets

KEY MECHANISM

BACKGROUND OF THE INVENTION

1. Field of the Invention

The invention relates to a key mechanism, and more particularly to a key mechanism preventing a linking bar from separating from a base plate.

2. Description of the Related Art

Generally, in a key mechanism, a linking bar is disposed between a base plate and a keycap to enable uniform function of the keycap.

Referring to FIG. 1A and FIG. 1B, a conventional key mechanism 1 comprises a base plate 11, a keycap 12, and a linking bar 13. In FIG. 1A and FIG. 1B, depiction of a scissors linking device, an elastic dome, and a membrane circuit assembly is omitted to simplify the diagrams. A plurality of pivoting portions 11*a* is disposed on base plate 11. A plurality of engaging portions 12*a* is disposed on keycap 12. The linking bar 13 comprises a main body 13*a* and two free ends 13*b*. The main body 13*a* is rotatably engaged in the engaging portions 12*a* of the keycap 12 while the free ends 13*b* respectively pivot to the pivoting portions 11*a* of the base plate 11. When the keycap 12 is pressed, the main body 13*a* of the linking bar 13 moves with the keycap 12 and the free ends 13*b* thereof rotate in the pivoting portions 11*a*.

When the keycap 12 is removed or separated from the base plate 11 due to collision, the linking bar 13 is also often separated from base plate 11 (or separated from the pivoting portions 11*a*) following the keycap 12. Accordingly, as the linking bar 13 must be assembled on the keycap 12 and base plate 11 using a specific means, re-assembly of the linking bar 13, keycap 12, and base plate 11 is inconvenient.

BRIEF SUMMARY OF THE INVENTION

A detailed description is given in the following embodiments with reference to the accompanying drawings.

An exemplary embodiment of the invention provides a key mechanism comprising a base plate, a keycap, and a linking bar. The base plate comprises a first pivoting portion and a second pivoting portion opposing the first pivoting portion. The keycap is disposed on the base plate and comprises at least one engaging portion. The linking bar is connected between the base plate and the keycap and comprises a first body portion, two second body portions, and two curved portions. The first body portion is rotatably engaged in the engaging portion of the keycap. The second body portions are connected to the first body portion and oppose each other. The curved portions are connected to the second body portions and pivot to the first and second pivoting portions of the base plate, respectively.

The first pivoting portion comprises a first pivoting hole. The second pivoting portion comprises a second pivoting hole. The curved portions are rotatably disposed in the first and second pivoting holes, respectively.

A central axis of the first pivoting hole is aligned with or perpendicular to that of the second pivoting hole.

The first or second pivoting portion protrudes from the base plate and has a substantially L-shaped profile.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

First Embodiment

Figure 1A:
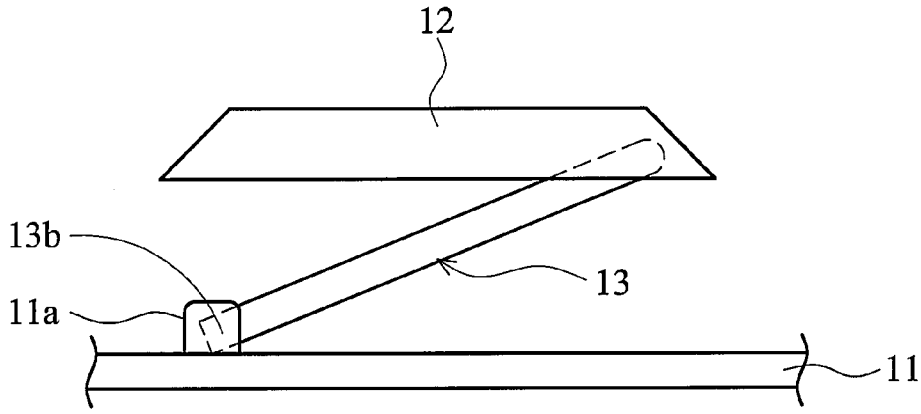
FIG. 1A ( PRIOR ART )
FIG. 1A is a partial side view of a conventional key mechanism.
Figure 1B:
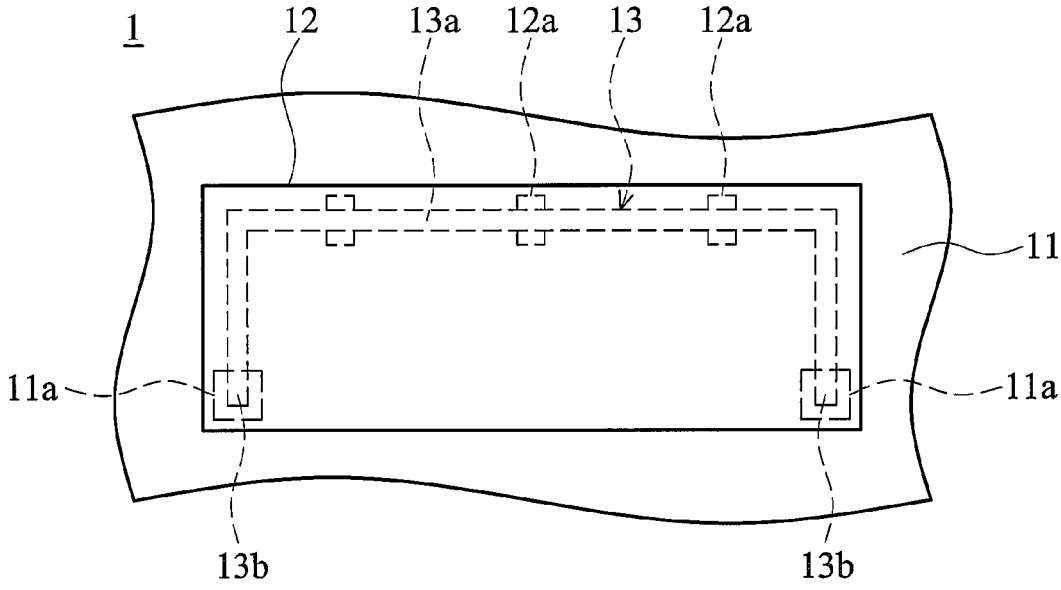
FIG. 1B ( PRIOR ART )
FIG. 1B is a schematic top view of FIG. 1A.
Figure 2A:
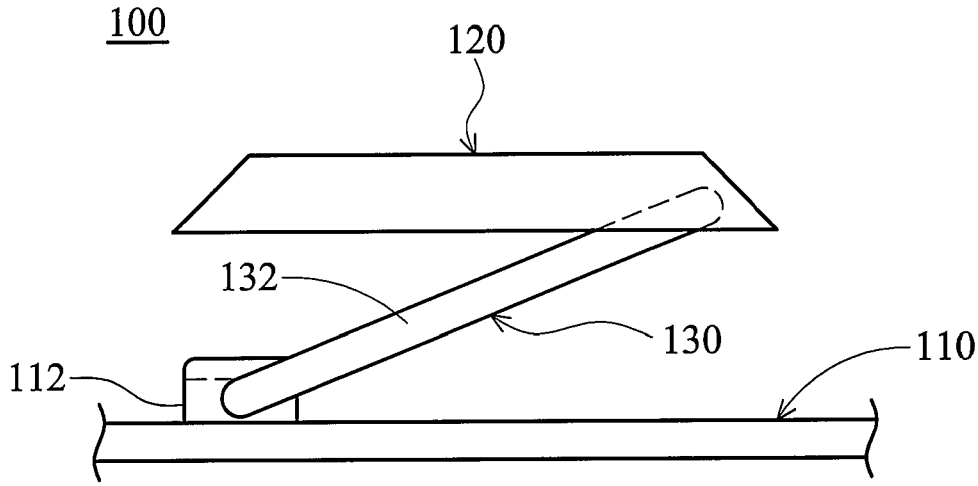
FIG. 2A is a partial side view of a key mechanism of a first embodiment of the invention.
Figure 2B:
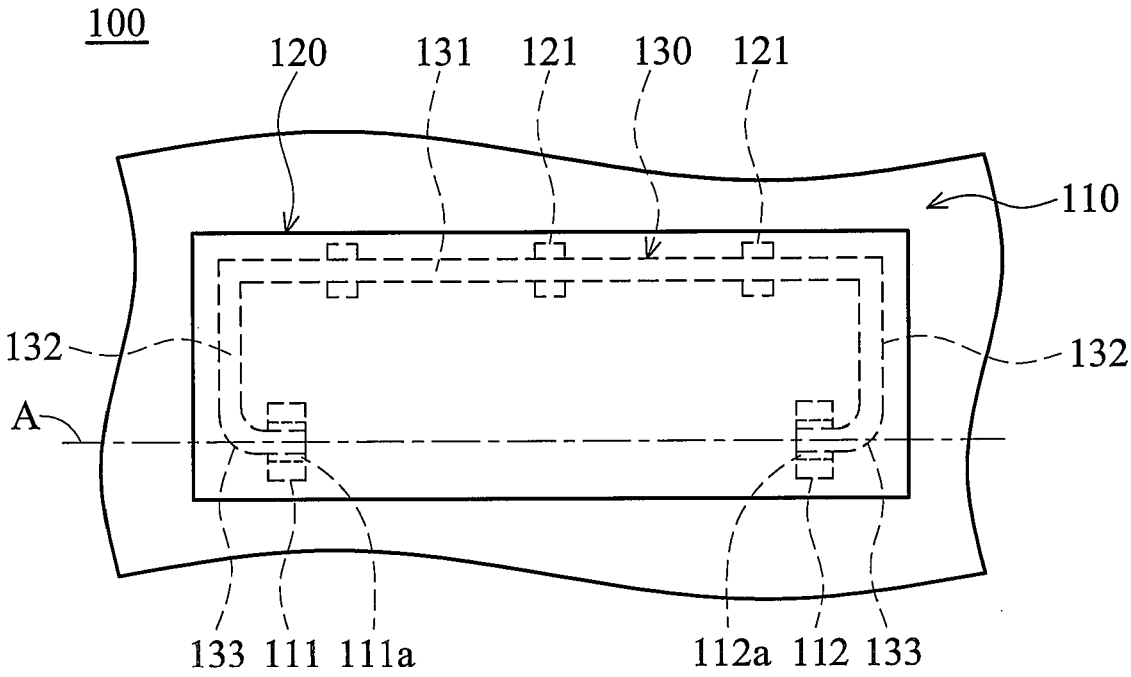
FIG. 2B is a schematic top view of FIG. 2A.

Referring to FIG. 2A and FIG. 2B, a key mechanism 100 comprises a base plate 110, a keycap 120, and a linking bar 130.

The base plate 110 comprises a first pivoting portion 111 and a second pivoting portion 112. The first pivoting portion 111 and second pivoting portion 112 protrude from the base plate 110 and oppose each other. Moreover, the first pivoting portion 111 comprises a first pivoting hole 111*a*, and the second pivoting portion 112 comprises a second pivoting hole 112*a*. Specifically, a central axis of the first pivoting hole 111*a* is aligned with that of the second pivoting hole 112*a*, as depicted by line A in FIG. 2B.

The keycap 120 is disposed on the base plate 110 and comprises a plurality of engaging portions 121.

The linking bar 130 is connected between the base plate 110 and the keycap 120 and comprises a first body portion 131, two second body portions 132, and two curved portions 133. The first body portion 131 is rotatably engaged in the engaging portions 121 of the keycap 120. The second body portions 132 are connected to the first body portion 131 and oppose each other. The curved portions 133 are connected to the second body portions 132 and pivot to the first pivoting portion 111 and second pivoting portion 112 of the base plate 110, respectively. Specifically, the curved portions 133 are rotatably disposed in the first pivoting hole 111*a* (of the first pivoting portion 111) and second pivoting hole 112*a* (of the second pivoting portion 112), respectively.

Accordingly, because of the construction of the curved portions 133 of the linking bar 130 and connection between the curved portions 133, the first pivoting portion 111, and the second pivoting portion 112, the linking bar 130 is not separated from the base plate 110 (or the first pivoting portion 111 and second pivoting portion 112) following the keycap 120 even if the keycap 120 is removed from the base plate 110 or separated therefrom due to collision. Thus, re-assembly of the linking bar 130, keycap 120, and base plate 110 is not required.

Second Embodiment

Elements corresponding to those in the first embodiment share the same reference numerals.

Figure 3A:
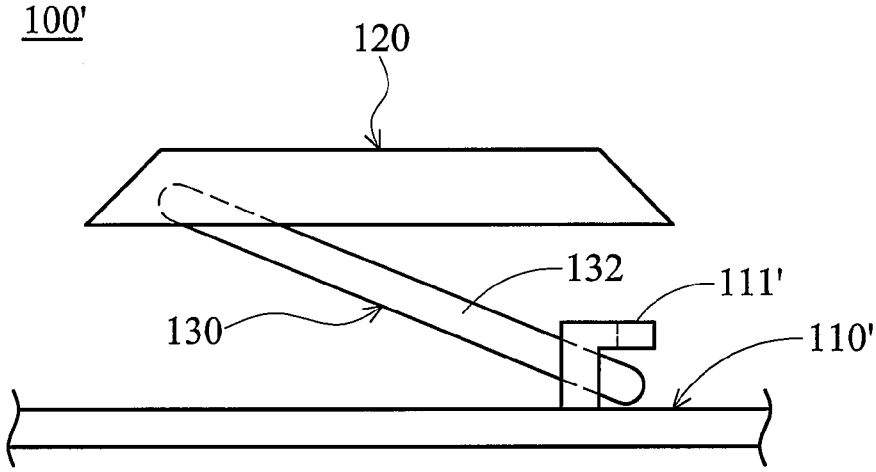
FIG. 3A is a partial side view of a key mechanism of a second embodiment of the invention.
Figure 3B:
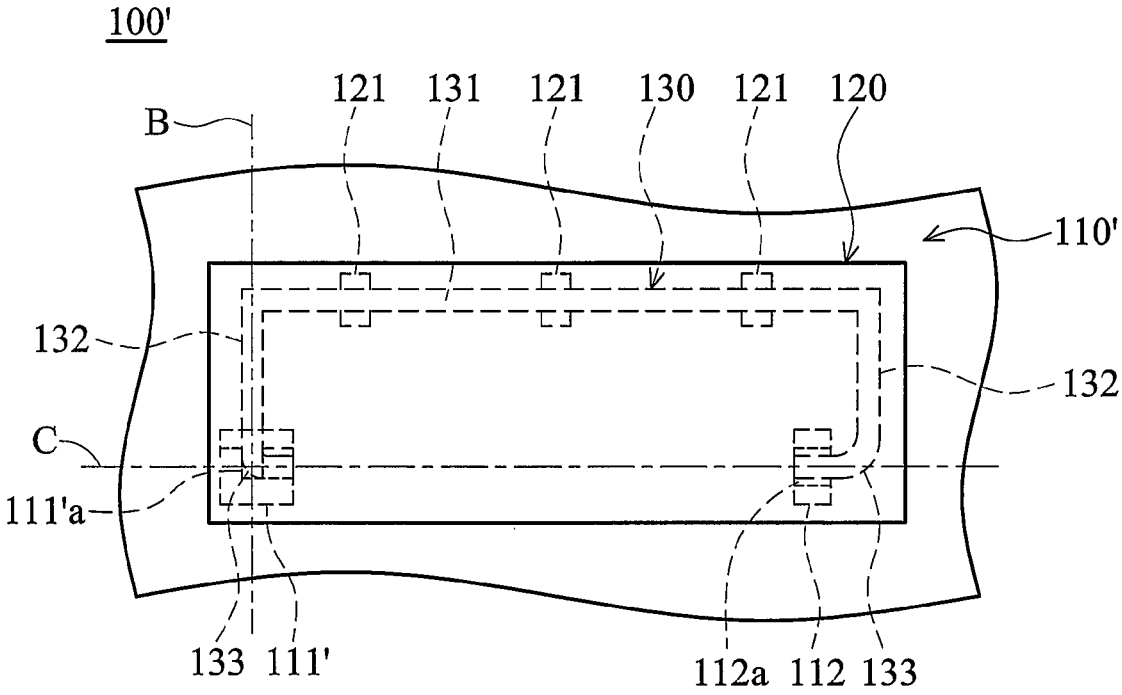
FIG. 3B is a schematic top view of FIG. 3A.

Referring to FIG. 3A and FIG. 3B, a key mechanism 100' comprises a base plate 110', a keycap 120, and a linking bar

130. The base plate 110' comprises a first pivoting portion 111' and a second pivoting portion 112.

The difference between this and the first embodiments is that disposition of the first pivoting portion 111' and second pivoting portion 112 of the key mechanism 100' is different from that of the first pivoting portion 111 and second pivoting portion 112 of the key mechanism 100 and construction of the first pivoting portion 111' is different from that of the first pivoting portion 111.

As shown in FIG. 3B, the first pivoting portion 111' comprises a first pivoting hole 111'*a*, and the second pivoting portion 112 comprises a second pivoting hole 112*a*. Specifically, a central axis (as depicted by line B) of the first pivoting hole 111'*a* is perpendicular to a central axis (as depicted by line C) of the second pivoting hole 112*a*. Moreover, as shown in FIG. 3A, the first pivoting portion 111' has a substantially L-shaped profile.

Structure, disposition, and function of other elements in this embodiment are the same as those in the first embodiment, and explanation thereof is omitted for simplicity.

Similarly, because of the construction of the curved portions 133 of the linking bar 130 and connection between the curved portions 133, the first pivoting portion 111', and the second pivoting portion 112, the linking bar 130 is not separated from the base plate 110' (or the first pivoting portion 111' and second pivoting portion 112) following the keycap 120 even if the keycap 120 is removed from the base plate 110' or separated therefrom due to collision. Thus, re-assembly of the linking bar 130, keycap 120, and base plate 110' is not required.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A key mechanism, comprising:

a base plate comprising a first pivoting portion and a second pivoting portion opposing the first pivoting portion, wherein the first pivoting portion comprises a first pivoting hole, the second pivoting portion comprises a second pivoting hole, and a central axis of the first pivoting hole is perpendicular to that of the second pivoting hole;

a keycap disposed on the base plate and comprising at least one engaging portion; and a linking bar connected between the base plate and the keycap and comprising a first body portion, two second body portions, and two curved portions, wherein the first body portion is rotatably engaged in the engaging portion of the keycap, the second body portions are connected to the first body portion and oppose each other, the curved portions are connected to the second body portions and pivot to the first and second pivoting portions of the base plate, respectively, and the curved portions are rotatable disposed in the first and second pivoting holes, respectively.

2. The key mechanism as claimed in claim 1, wherein a central axis of the first pivoting hole is aligned with that of the second pivoting hole.

3. The key mechanism as claimed in claim 1, wherein the first pivoting portion protrudes from the base plate and has a substantially L-shaped profile.

4. The key mechanism as claimed in claim 1, wherein the second pivoting portion protrudes from the base plate and has a substantially L-shaped profile.

* * * * *